US009027253B2

(12) United States Patent
Huang

(10) Patent No.: US 9,027,253 B2
(45) **Date of Patent: *May 12, 2015**

(54) COMPOUND ACTION SNIPS

(75) Inventor: Hsin-Te Huang, Taichung (TW)

(73) Assignee: AllProfessional Mfg. Co., Ltd, Taichung (TW)

( * ) Notice: Subject to any disclaimer, the term of this patent is extended or adjusted under 35 U.S.C. 154(b) by 118 days.

This patent is subject to a terminal disclaimer.

(21) Appl. No.: 13/413,708

(22) Filed: Mar. 7, 2012

(65) Prior Publication Data

US 2013/0232797 A1 Sep. 12, 2013

(51) Int. Cl.
*B26B 13/26* (2006.01)
*B26B 13/12* (2006.01)
*B26B 13/28* (2006.01)

(52) U.S. Cl.
CPC ..... *B26B 13/26* (2013.01); *B26B 13/12* (2013.01); *B26B 13/28* (2013.01)

(58) Field of Classification Search
CPC ..... A01G 3/02; A01G 3/025; A01G 3/065; B23D 29/02; B23D 29/023; B23D 29/026; B26B 13/00; B26B 13/12; B26B 13/26; B26B 13/28; B26B 17/02
USPC ..... 30/186–188, 190, 191, 193, 244–252, 30/262; D8/5, 52
See application file for complete search history.

(56) References Cited

U.S. PATENT DOCUMENTS 1,818,237 A * 8/1931 Medean, Jr. ..... 30/193
2,504,766 A * 4/1950 Vosbikian ..... 30/262
2,655,722 A * 10/1953 Klenk ..... 30/252
3,839,794 A * 10/1974 Deale ..... 30/248
D255,980 S * 7/1980 Winget ..... D8/52
4,439,923 A * 4/1984 Scranton ..... 30/252
4,967,475 A * 11/1990 O'Keeffe et al. ..... 30/252
5,003,695 A * 4/1991 Lipscomb et al. ..... 30/193
D406,507 S * 3/1999 Mock ..... D8/52
6,189,219 B1 2/2001 Mock ..... 30/252
6,249,977 B1 * 6/2001 Knoop ..... 30/251
D453,458 S * 2/2002 Huang ..... D8/57
D457,791 S * 5/2002 Clivio ..... D8/5
6,574,870 B1 * 6/2003 Huang ..... 30/252
6,598,300 B2 * 7/2003 Huang ..... 30/262
6,752,054 B2 * 6/2004 Knight ..... 30/251
D501,378 S * 2/2005 Tatic ..... D8/5
D519,013 S * 4/2006 Schmick ..... D8/52
D520,315 S * 5/2006 Deter ..... D8/52

(Continued)

OTHER PUBLICATIONS

Taiwanese Utility Model Publication No. TW 410737, Nov. 1, 2000, 3 pages.

(Continued)

*Primary Examiner* — Jason Daniel Prone
(74) *Attorney, Agent, or Firm* — Alan D. Kamrath; Kamrath IP Lawfirm, P.A.

(57) ABSTRACT

Compound action snips includes include first and second handles pivotally connected to each other, and first and second blades. The first handle includes first and second walls arranged opposite to each other. The second wall includes a recess. The first blade is mounted to the first handle. The second blade is mounted to the second handle. A fastener inserts through the first wall, the first blade, and the second wall. A fixing element is received into the recess and threaded onto the fastener, so that a top surface defined on the fixing element is not exposed out of the second wall of the first handle.

5 Claims, 12 Drawing Sheets

(56) References Cited

U.S. PATENT DOCUMENTS

| | | | | |
|---|---|---|---|---|
| 7,346,991 | B1 * | 3/2008 | Janson | 30/244 |
| D618,078 | S * | 6/2010 | Cripps et al. | D8/52 |
| D623,498 | S * | 9/2010 | Wong | D8/107 |
| D631,322 | S * | 1/2011 | Wong | D8/52 |
| 7,895,757 | B1 * | 3/2011 | Huang | 30/250 |
| 8,316,549 | B2 * | 11/2012 | Musser | 30/262 |
| 8,327,549 | B2 * | 12/2012 | Huang | 30/251 |
| D695,082 | S * | 12/2013 | Huang | D8/5 |
| D696,568 | S * | 12/2013 | Huang | D8/107 |
| 2006/0137192 | A1 * | 6/2006 | Deter | 30/248 |
| 2007/0163126 | A1 * | 7/2007 | Huang | 30/175 |
| 2009/0172954 | A1 * | 7/2009 | Novak et al. | 30/244 |
| 2013/0160301 | A1 * | 6/2013 | Huang | 30/252 |
| 2013/0232798 | A1 * | 9/2013 | Huang | 30/252 |

OTHER PUBLICATIONS

Chinese Utility Model Publication No. CN 202192320 U, Apr. 18, 2012, 12 pages.

* cited by examiner

COMPOUND ACTION SNIPS

BACKGROUND OF THE INVENTION

1. Field of the Invention

The present invention relates to compound action snips and, more particularly, to compound action snips able to cut an object without being interfered with by the object.

2. Description of the Related Art

U.S. Pat. No. 6,189,219 shows compound action snips including a pair of handles mutually connected at a second fastener and a pair of cutting blades connected to the handles. Each blade has a proximal end attached to a distal portion of one of the handles, and the blades are mutually connected at a blade pivot, so that converging movement of the handles causes converging movement of the blades. However, the second fastener exposed out of the external surface of the handle results in undesirable interference between the second fastener and an object being cut during cutting.

The present invention is, therefore, intended to obviate or at least alleviate the problems encountered in the prior art.

SUMMARY OF THE INVENTION

According to the present invention, compound action snips include first and second handles pivotally connected to each other, and first and second blades. The first handle includes first and second walls arranged opposite to each other. The second wall includes a recess. The first blade is mounted to the first handle. The second blade is mounted to the second handle. A fastener inserts through the first wall, the first blade, and the second wall. A fixing element is received into the recess and threaded onto the fastener, so that a top surface defined on the fixing element is not exposed out of the second wall of the first handle.

In view of the foregoing, it is an object of the present invention that the fixing element is received in the recess, so that the part of the object is not interfered with by the fixing element.

Other objects, advantages, and new features of the present invention will become apparent from the following detailed description of the invention when considered in conjunction with the accompanied drawings.

BRIEF DESCRIPTION OF THE DRAWINGS

For the present disclosure to be easily understood and readily practiced, the present disclosure will now be described for the purpose of illustration but not limitation, in conjunction with the following figures, wherein.

Figure 1:
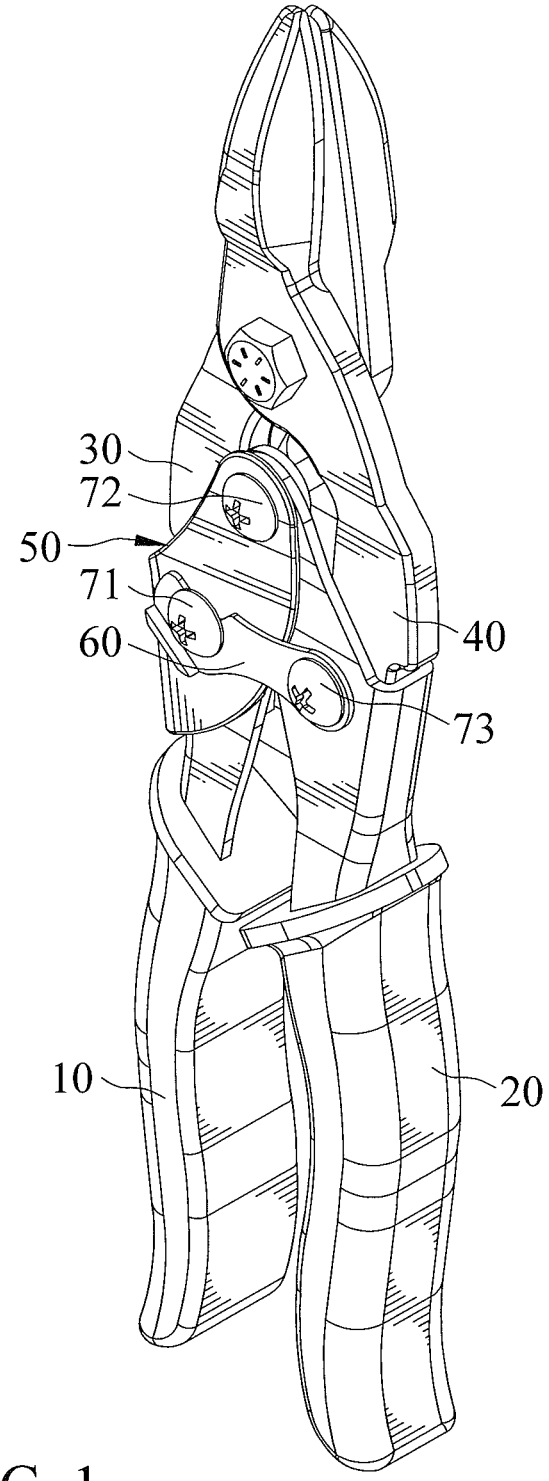
FIG. 1 is a perspective view of compound action snips in accordance with a first embodiment of the present invention, illustrating the snips in a closed position.
Figure 2:
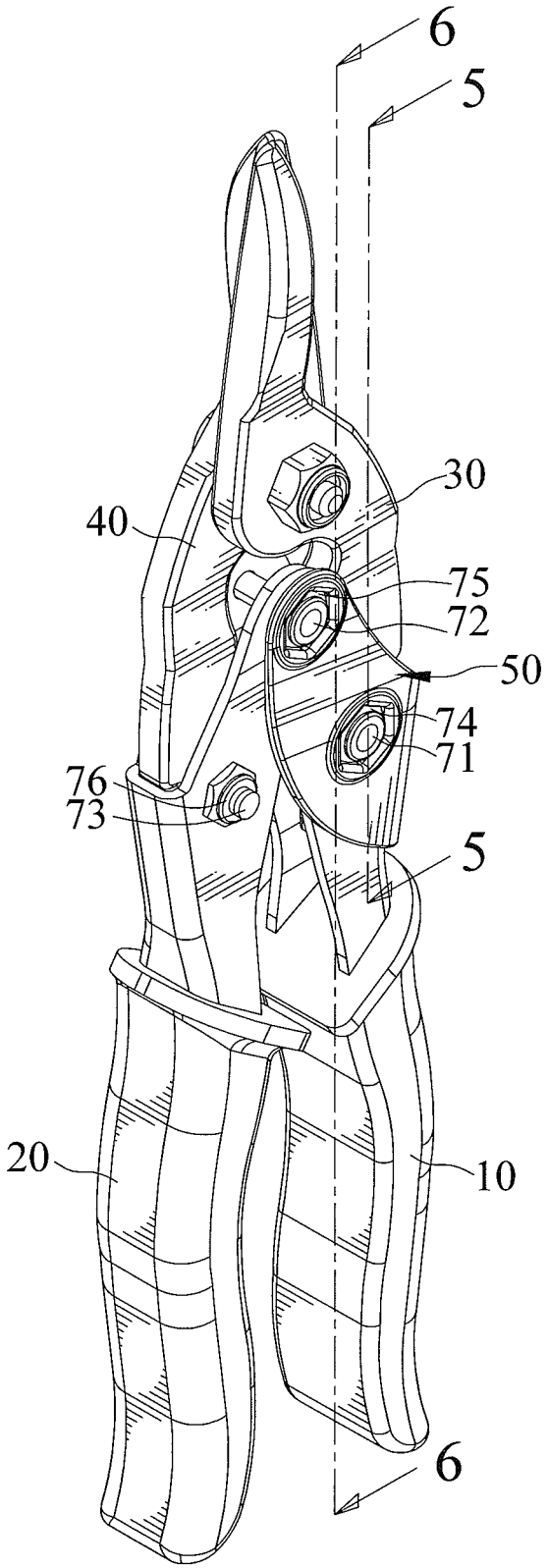
FIG. 2 is another perspective view of the snips of FIG. 1.
Figure 3:
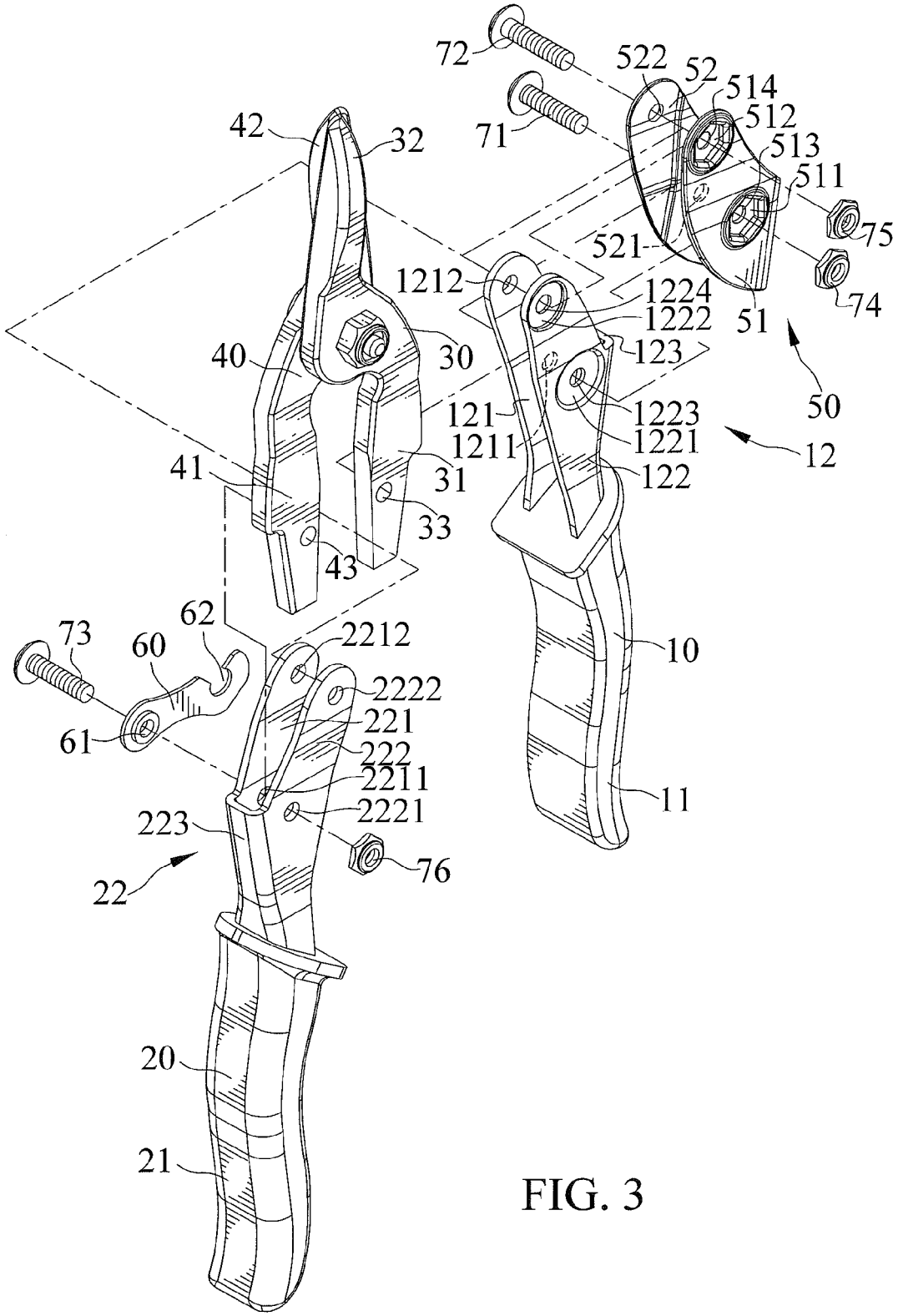
FIG. 3 is an exploded perspective view of the snips of FIG. 2.
Figure 4:
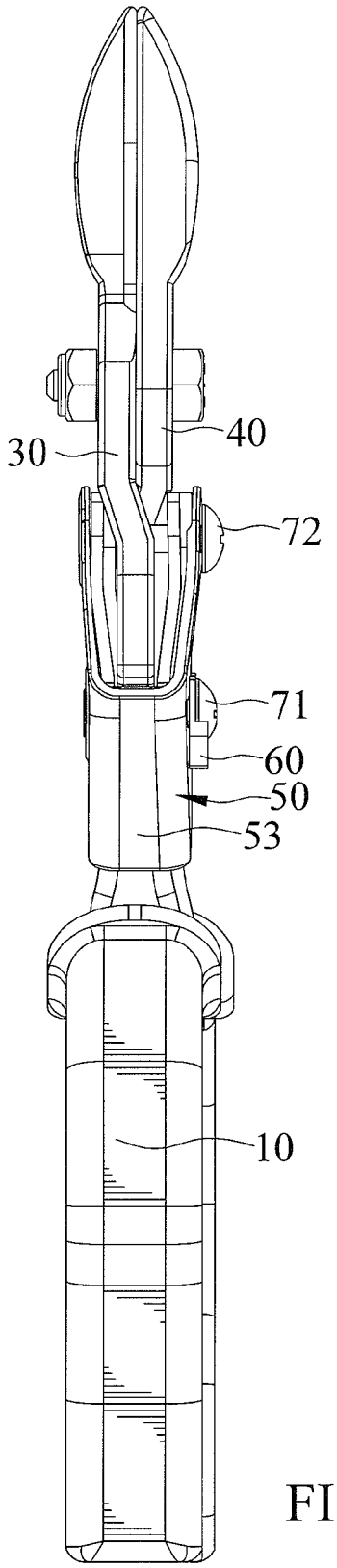
FIG. 4 is a side view of the snips of FIG. 1.
Figure 5:
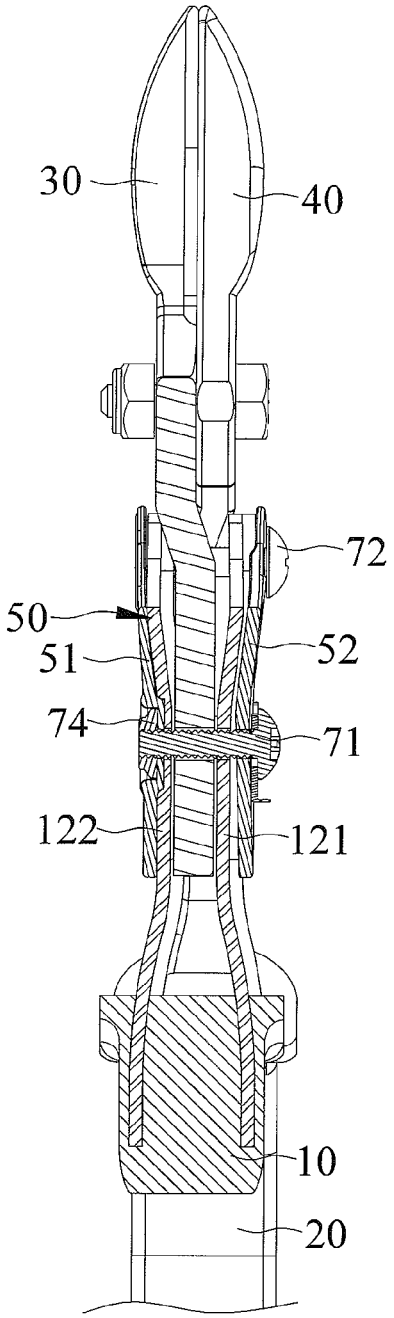
FIG. 5 is a cross sectional view taken along line 5-5 of the snips of FIG. 2.
Figure 6:
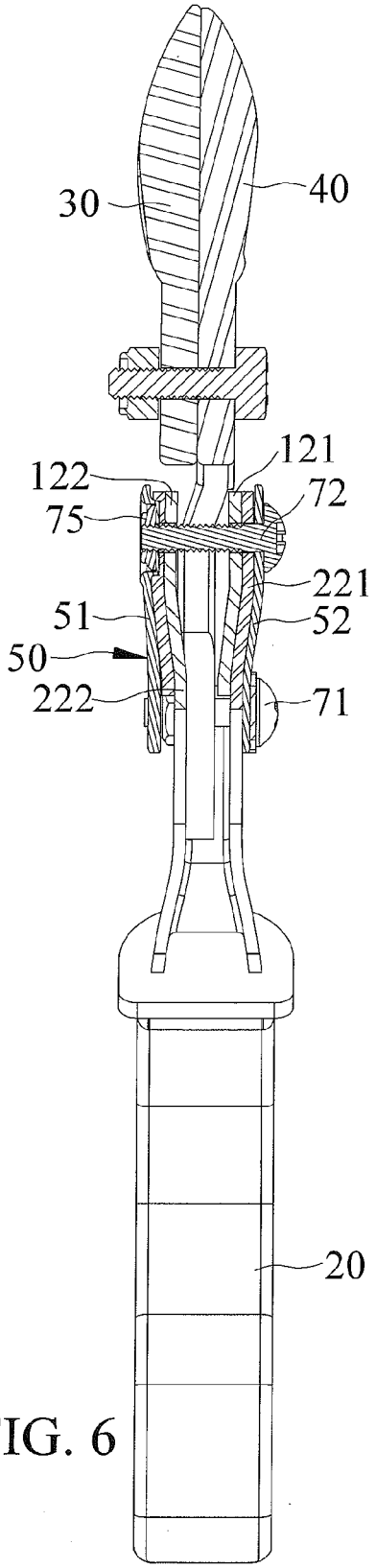
FIG. 6 is a cross sectional view taken along line 6-6 of the snips of FIG. 2.
Figure 7:
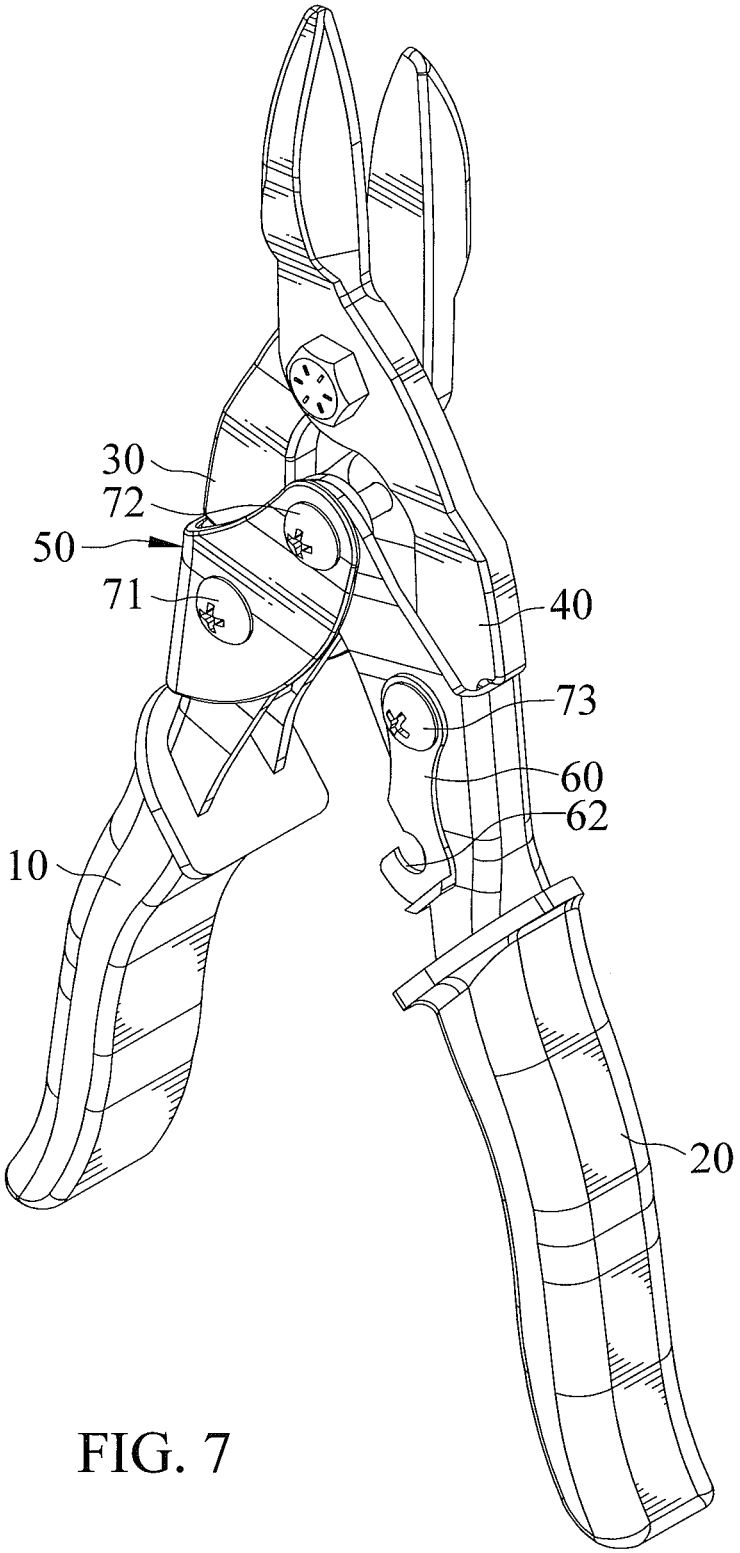
FIG. 7 is a perspective view of the snips of FIG. 1, illustrating the snips in an open position.
Figure 8:
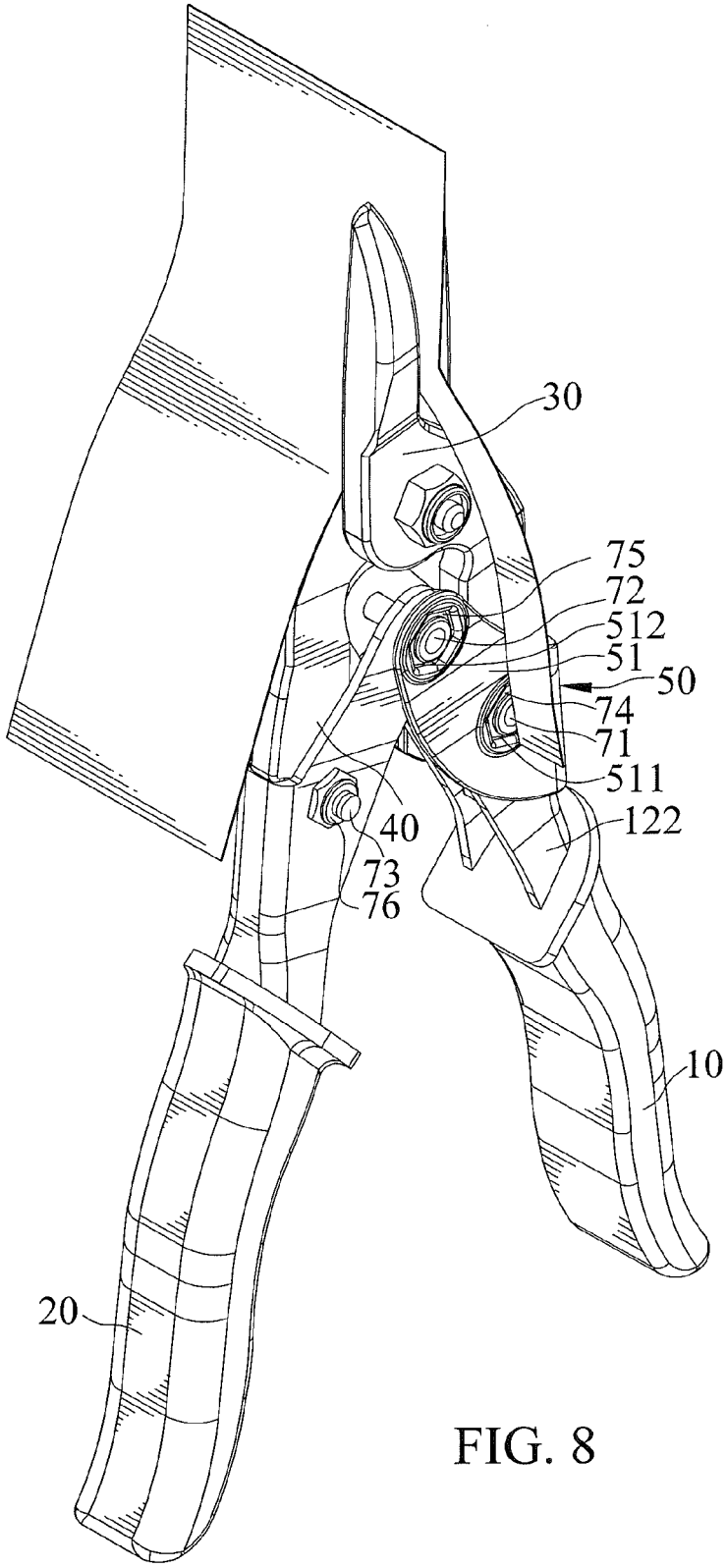
FIG. 8 is a perspective view of the snips of FIG. 7, illustrating the snips cutting an object.
Figure 9:
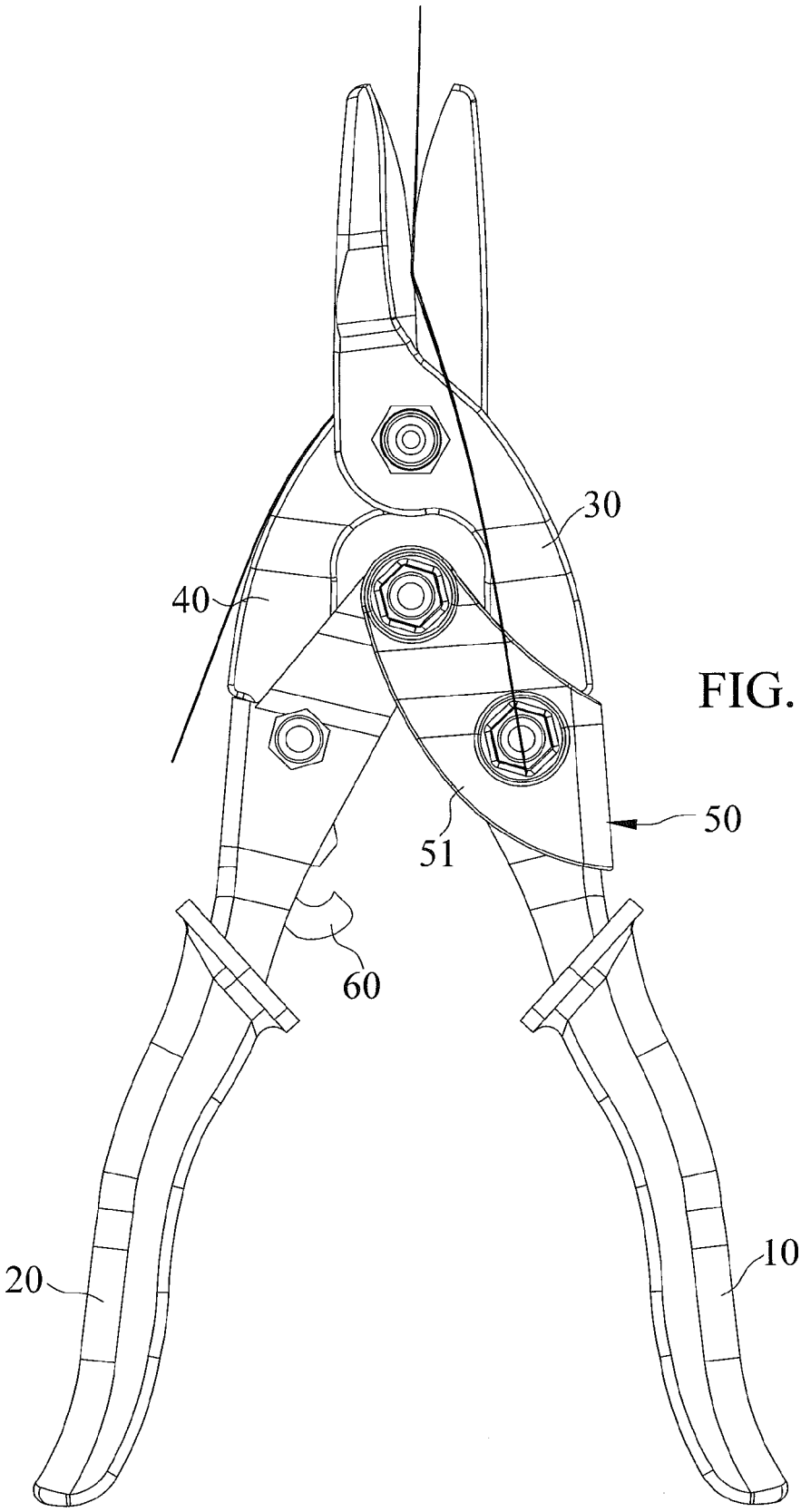
FIG. 9 is a front view of the snips of FIG. 7.
Figure 10:
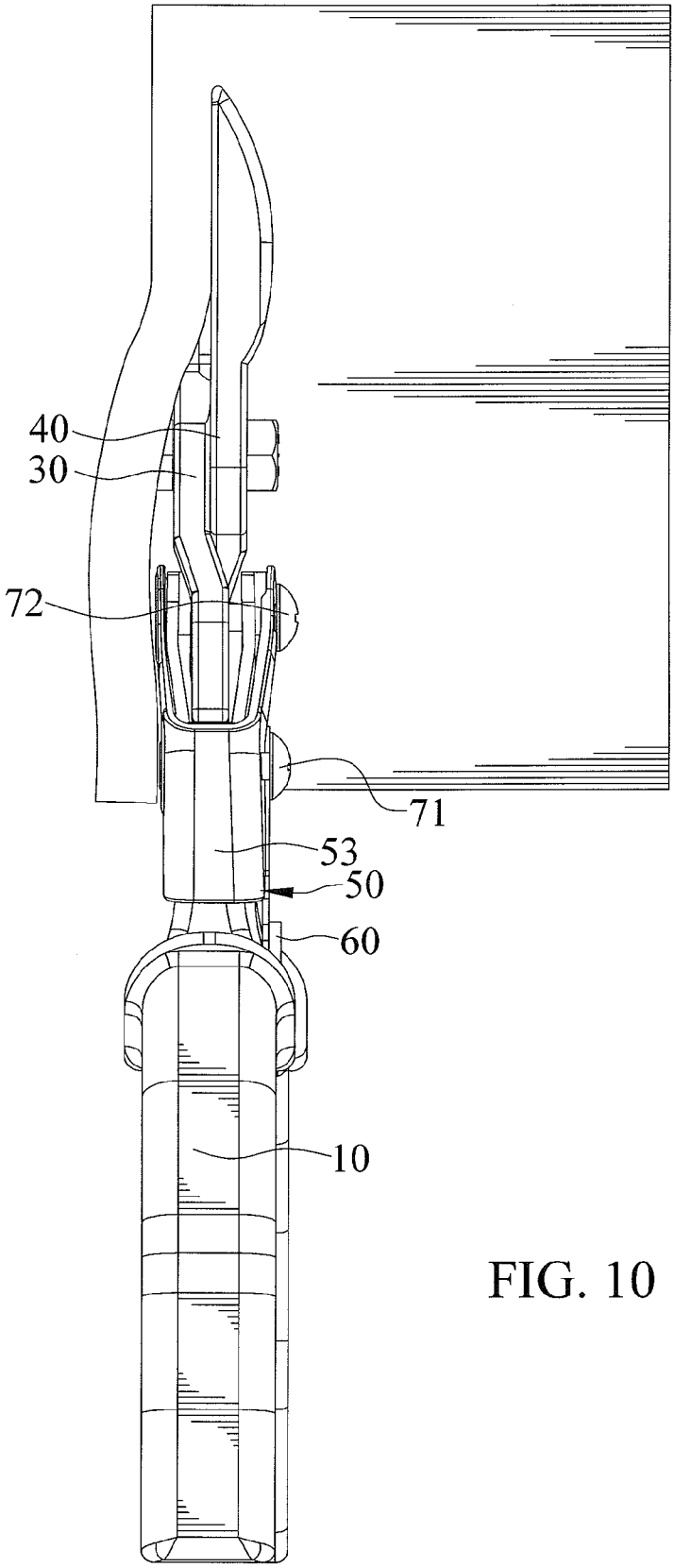
FIG. 10 is a side view of the snips of FIG. 7.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "longitudinal", "clockwise", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENTS

Referring to FIGS. 1 through 6, compound action snips according to the first embodiment of the present invention generally includes first and second handles 10 and 20, first and second blades 30 and 40, and a nameplate 50 therein. The first and second handles 10 and 20 are mutually connected at a second fastener 72 fastened with a second fixing element 75. The first and second blades 30 and 40 are respectively mounted to the first and second handles 10 and 20 by first and third fasteners 71 and 73 respectively fastened with first and third fixing elements 74 and 76. The first, second, and third fasteners 71, 72, and 73 may comprise bolts, as shown in the figures, or any suitable fastener, and the first, second, and third fixing elements 74, 75, and 76 may comprise nuts.

The first handle 10 includes first distal and first proximal ends 11 and 12 disposed opposite to each other therein. The first distal end 11 provides a user to grip thereon. The first proximal end 12 is formed in a U-shape generally and includes first and second walls 121 and 122, and a first connecting wall 123 therein. The first and second walls 121 and 122 are arranged opposite to each other, and the first connecting wall 123 is disposed therebetween. The first wall 121 includes first and second holes 1211 and 1212. The second wall 122 includes first and second recesses 1221 and 1222, and third and fourth holes 1223 and 1224. The first hole 1211 is arranged corresponding to the first recess 1221 and the third hole 1223. The second hole 1212 is arranged corresponding to the second recess 1222 and the fourth hole 1224. The first and second recesses 1221 and 1222 are disposed on a surface of the second wall 122 opposite to the first wall 121.

The second handle 20 includes second distal and second proximal ends 21 and 22 disposed opposite to each other therein. The second distal end 21 allows the user to grip thereon. The second proximal end 22 is formed in a U-shape generally and includes third and fourth walls 221 and 222, and a second connecting wall 223 therein. The third and fourth walls 221 and 222 are arranged opposite to each other, and the second connecting wall 223 is disposed therebetween.

The third wall 221 includes fifth and sixth holes 2211 and 2212. The fourth wall 222 includes seventh and eighth holes 2221 and 2222 respectively arranged corresponding to the fifth and sixth holes 2211 and 2212.

The first and second blades 30 and 40 are mutually connected at a blade pivot (not numbered) which allows relative pivoting movement of the first and second blades 30 and 40. The blade pivot is located distally of the second fastener 72. The blade pivot is located distally of the second fastener 72. The snips have an open position in which the first and second handles 10 and 20 and the first and second blades 30 and 40 diverge from each other relative to the respective second fastener 72 and blade pivot. As may be understood by reference to the drawings, converging movement of the first and second handles 10 and 20, which is applied by the user, causes converging movement, that is, the cutting movement, of the first and second blades 30 and 40.

The first blade 30 includes a first connecting end 31 and a first cutting end 32. The first connecting end 31 is mounted to the first proximal end 12 and includes a ninth hole 33.

The second blade 40 includes a second connecting end 41 and a second cutting end 42. The second connecting end 41 is mounted to the second proximal end 22 and includes a tenth hole 43.

The nameplate 50 is formed in a U-shape generally and is mounted on the first proximal end 12 of the first handle 10 to be able to display patterns, or trademarks provided thereon. The nameplate 50 includes fifth and sixth walls 51 and 52, and a third connecting wall 53 therein. The fifth and sixth walls 51 and 52 are arranged opposite to each other, and the third connecting wall 53 is disposed therebetween and faces the first connecting wall 123. The fifth wall 51 includes third and fourth recesses 511 and 512 disposed on a surface thereof opposite to the sixth wall 52, and eleventh and twelfth holes 513 and 514. The fifth wall 51 faces the second wall 122. The eleventh and twelfth holes 513 and 514 are respectively arranged corresponding to the third and fourth holes 1223 and 1224. The third and fourth recesses 511 and 512 are respectively arranged corresponding to the first and second recesses 1221 and 1222. The sixth wall 52 includes thirteenth and fourteenth holes 521 and 522. The sixth wall 52 abuts against the first wall 121. The thirteenth and fourteenth holes 521 and 522 are respectively arranged corresponding to the first and second holes 1211 and 1212. The eleventh hole 513 is arranged in a bottom of the third recess 511 and corresponding to the thirteenth hole 521 and the third hole 1223. The twelfth hole 514 is arranged in a bottom of the fourth recess 512 and corresponding to the fourteenth hole 522 and the fourth hole 1224.

A latch 60 is pivotally mounted to the third fastener 73 and abuts against the third wall 221 of the second handle 20, and includes an orifice 61 and a retaining portion 62 disposed at two opposite ends thereof. The retaining portion 62 of the latch 60 can be buckled with the first fastener 71 mounted into the first handle 10 for holding the snips in a closed position.

In the embodiment, the first, second, and third fasteners 71, 72, and 73 are bolts, and the first, second, and third fasteners 74, 75, and 76 are nuts. The first fastener 71 is sequentially inserted through the thirteenth hole 521 of the sixth wall 52, the first hole 1211 of the first wall 121, the ninth hole 33 of the first blade 30, the third hole 1223 of the second wall 122, and the eleventh hole 513 of the fifth wall 51. The first fixing element 74 is received into the third recess 511 so that a top surface defined on the first fixing element 74 is not exposed out of the fifth wall 51 of the nameplate 50. Moreover, the first fixing element 74 is threaded onto the first fastener 71 to fasten the first handle 10, the first blade 30, and the nameplate 50. The second fastener 72 is sequentially inserted through the fourteenth hole 522 of the sixth wall 52, the second hole 1212 of the first wall 121, the sixth hole 2212 of the third wall 221, the eighth hole 2222 of the fourth wall 222, the fourth hole 1224 of the second wall 122, and the twelfth hole 514. The second fixing element 75 is received into the fourth recess 512, so that a top surface defined on the second fixing element 75 is not exposed out of the fifth wall 51 of the nameplate 50. Moreover, the second fixing element 75 is threaded onto the second fastener 72, so that the first and second handles 10 and 20, and nameplate 50 are pivotally connected with each other.

The third fastener 73 is sequentially inserted through the orifice 61 of the latch 60, the fifth hole 2211 of the third wall 221, the tenth hole 43 of the second blade 40, and the seventh hole 2221 of the fourth wall 222. The third fixing element 76 abuts against the fourth wall 222 and threaded onto the third fastener 73, so that the second handle 20 and the second blade 40 are connected with each other and so that the latch 60 is pivotally connected with the second handle 20.

The third fixing element 75 is received into the fourth recess 512, so that a top surface defined on the second fixing element 75 is not exposed out of the fifth wall 51 of the nameplate 50. Moreover, the second fixing element 75 is threaded onto the second fastener 72, so that the first and second handles 10 and 20, and nameplate 50 are pivotally connected with each other.

Referring to FIGS. 7 through 10, the retaining portion 62 of the latch 60 selectively buckles with an end of the first fastener 71 disposed opposite the first fixing element 74 to provide the snips in the open or closed position. When the snips cut an object through a straight path, a part of the object is formed adjacent to a side of the first blade 30 and the fifth wall 51 of the nameplate 50 (shown in FIGS. 9 and 10). The first and second fixing elements 74 and 75 are respectively received in the first and second recesses 1221 and 1222, so that the part of the object formed adjacent to the side of the first blade 30 and the fifth wall 51 is not interfered with the first and second fixing elements 74 and 75.

Figure 11:
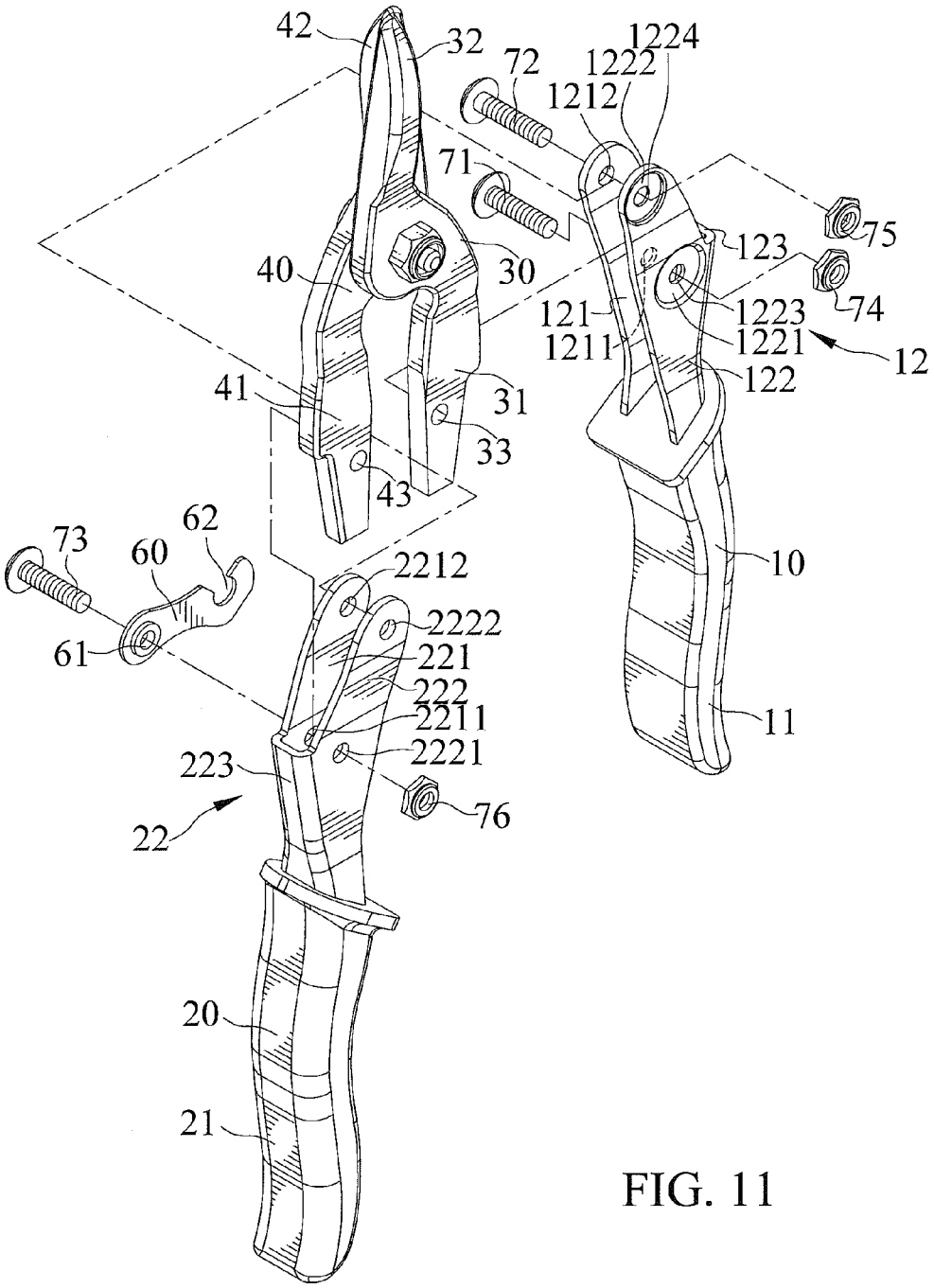
FIG. 11 is an exploded view of the snips in accordance with a second embodiment of the present invention.

FIG. 11 shows a snipes in accordance with a second embodiment of the present invention. The second embodiment differentiates from the first embodiment in that it does not include the nameplate 50. The first fastener 71 is sequentially inserted through the first hole 1211 of the first wall 121, the ninth hole 33 of the first blade 30, and the third hole 1223 of the second wall 122. Further, the first fixing element 74 is received into the third recess 511, so that the top surface defined on the first fixing element 74 is not exposed out of the second wall 122 of the first proximal end 12. The second fastener 72 is sequentially inserted through the second hole 1212 of the first wall 121, the sixth hole 2212 of the third wall 221, the eighth hole 2222 of the fourth wall 222, and the fourth hole 1224 of the second wall 122. The second fixing element 75 is received into the second recess 1222, so that the top surface defined on the second fixing element 75 is not exposed out of the second wall 122 of the first proximal end 12.

Figure 12:
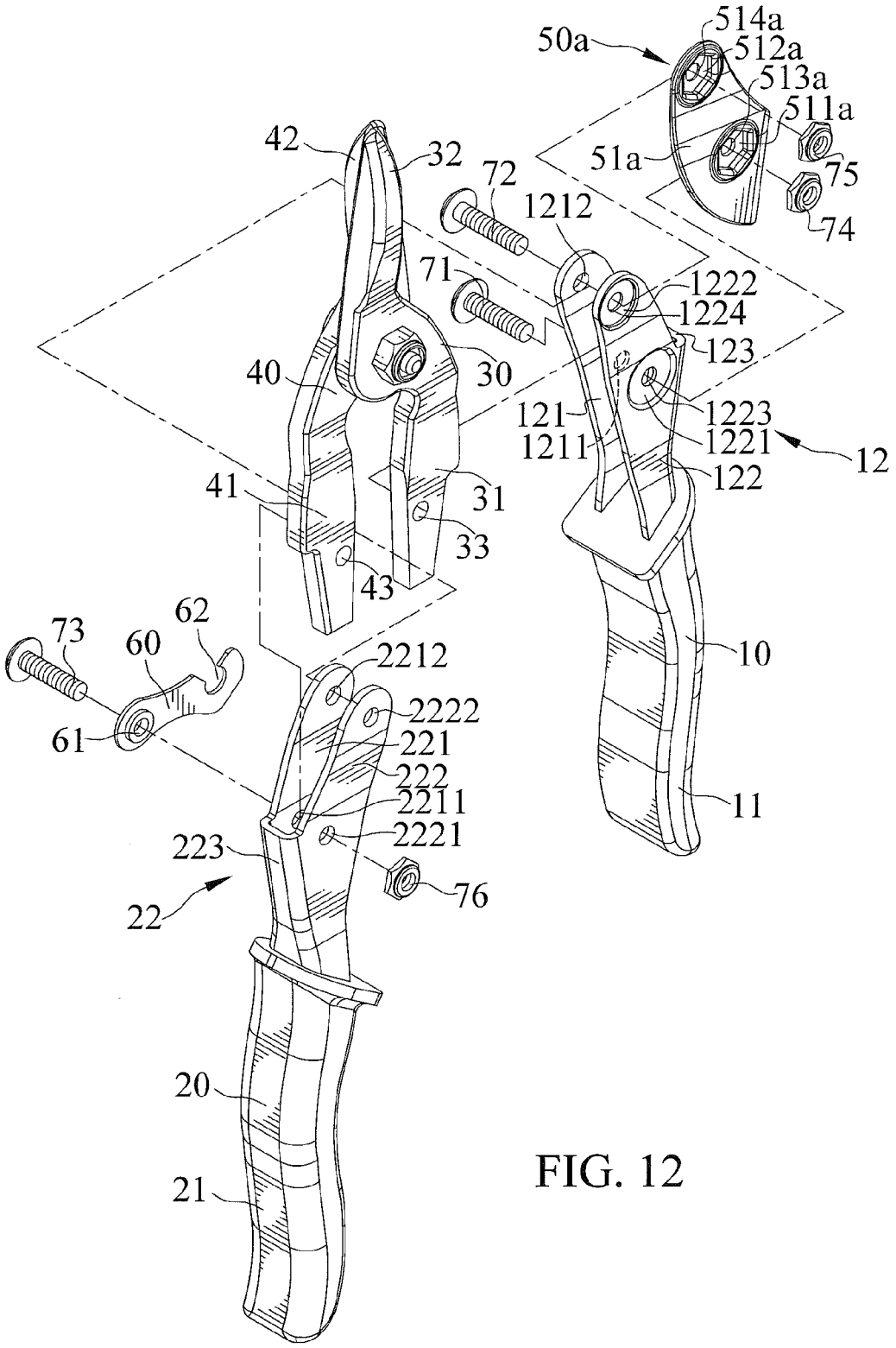
FIG. 12 is an exploded view of the snips in accordance with a third embodiment of the present invention.
Figure 13:
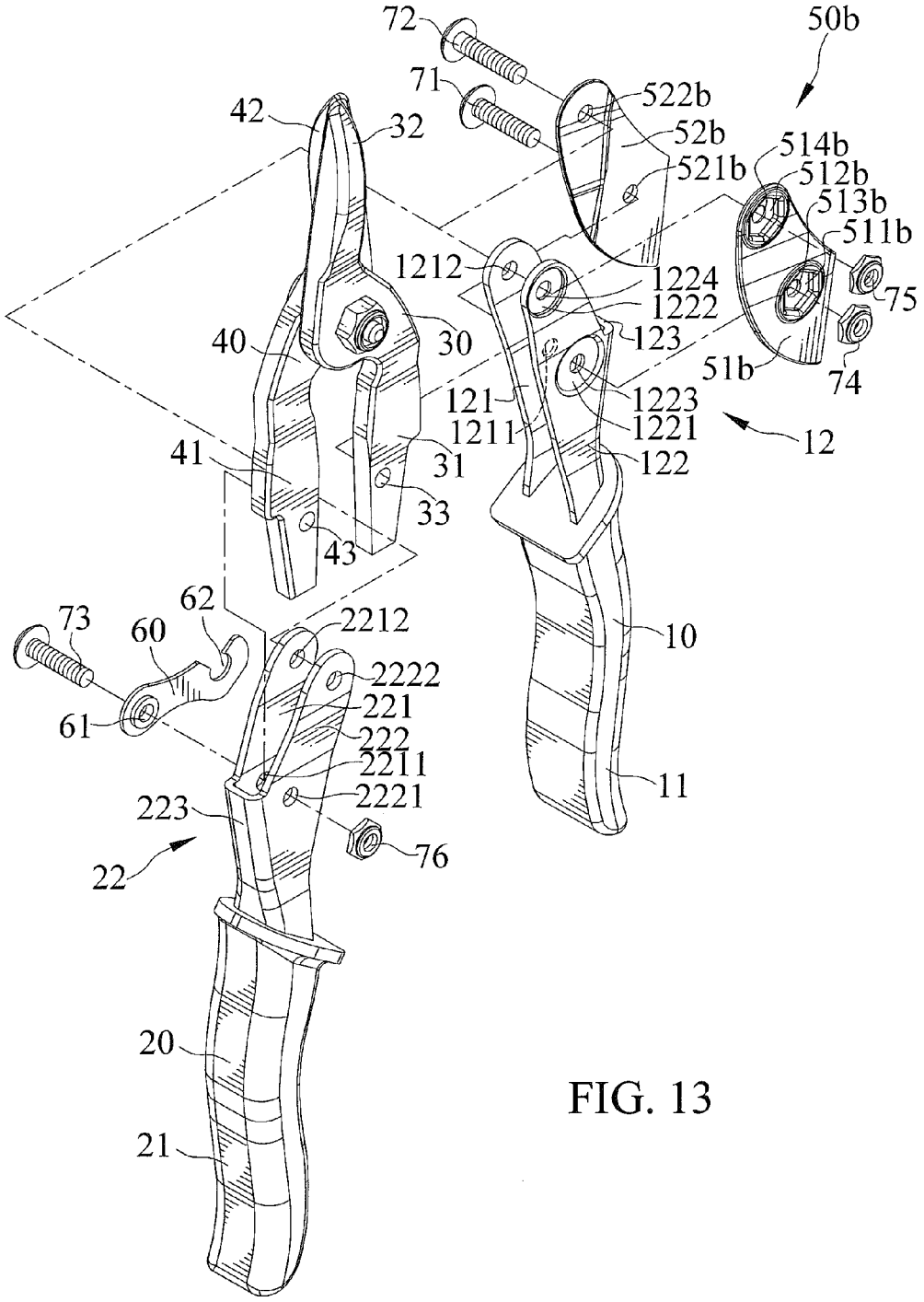
FIG. 13 is an exploded view of the snips in accordance with a fourth embodiment of the present invention.

FIG. 12 shows a snipes in accordance with a third embodiment of the present invention. The structure of the snips with the third embodiment is similar to the first embodiment substantially except the nameplate 50*a*. However, the nameplate 50*a* includes a fifth wall 51*a* abutted against the second wall 122 of the first proximal end 12. The fifth wall 51*a* includes third and fourth recesses 511*a* and 512*a* disposed on a surface thereof, and eleventh and twelfth holes 513*a* and 514*a*. The first fastener 71 is sequentially inserted through the first hole 1211 of the first wall 121, the ninth hole 33 of the first blade 30, the third hole 1223 of the second wall 122, and the eleventh hole 513*a* of the fifth wall 51*a*. The first fixing element 74 is received into the third recess 511*a*, so that the top surface defined on the first fixing element 74 is not exposed out of the fifth wall 51*a* of the nameplate 50*a*. The second fixing element 75 is received into the fourth recess 512*a*, so that a top surface defined on the second fixing element 75 is not exposed out of the fifth wall 51*a* of the nameplate 50.

FIG. 14 shows a snipes in accordance with a fourth embodiment of the present invention. The structure of the snips with a fourth embodiment is similar to the first embodiment substantially except the nameplate 50*b*. However, the nameplate 50*b* includes fifth and sixth walls 51*b* and 52*b* formed separately. The fifth wall 51*b* is abutted against the second wall 122 of the first proximal end 12, and the sixth wall 52*b* is abutted against the first wall 121 of the first proximal end 12.

The fifth wall 51*b* includes third and fourth recesses 511*b* and 512*b* disposed on a surface thereof, and eleventh and twelfth holes 513*b* and 514*b*. The sixth wall 52*b* includes thirteenth and fourteenth holes 521*b* and 522*b*. The eleventh hole 513*b* is arranged in a bottom of the third recess 511*b* and corresponding to the thirteenth hole 521*b* and the third hole 1223. The twelfth hole 514*b* is arranged in a bottom of the fourth recess 512*b* and corresponding to the fourteenth hole 522*b* and the fourth hole 1224.

The first fastener 71 is sequentially inserted through the thirteenth hole 521*b* of the sixth wall 52*b*, the first hole 1211 of the first wall 121, the ninth hole 33 of the first blade 30, the third hole 1223 of the second wall 122, and the eleventh hole 513*b* of the fifth wall 51*b*. The first fixing element 74 is received into the third recess 511*b*, so that a top surface defined on the first fixing element 74 is not exposed out of the fifth wall 51*b* of the nameplate 50*b*. The second fixing element 75 is received into the fourth recess 512*b*, so that a top surface defined on the second fixing element 75 is not exposed out of the fifth wall 51*b* of the nameplate 50.

In view of the foregoing, it is an object of the present invention that the fixing elements 74 and 75 are respectively received in the recesses 1221, 1222; 511, 512; 511*a*, 512*a*; 511*b*, 512*b*, so that the part of the object without being interfered with the fixing elements 74 and 75.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Compound action snips comprising:

a first handle including first distal and first proximal ends disposed opposite to each other, with the first proximal end including first and second walls arranged opposite to each other, with each of the first and second walls including a hole;

a second handle pivotally connected with the first handle and including second distal and second proximal ends disposed opposite to each other;

a first blade including a first connecting end and a first cutting end, with the first connecting end located intermediate the first and second walls of the first proximal end, with the first connecting end including a hole;

a second blade including a second connecting end and a second cutting end, with the second connecting end mounted to the second proximal end, wherein the first and second cutting ends enable cutting an object;

a nameplate including a fifth wall having an inner surface abutted against the second wall of the first handle and having an outer surface opposite to the inner surface, with the fifth wall including a first recess extending from the outer surface and including a hole;

a first fastener inserting in an axial direction through the holes of the first wall, the first connecting end, the second wall and the fifth wall; and a first fixing element received into the first recess and threaded onto threads of the first fastener to fasten the first handle, the first blade and the nameplate;

wherein a top surface is defined on the first fixing element in the axial direction and opposite the second wall; wherein the top surface of the first fixing element received in the first recess is not exposed out of the fifth wall of the nameplate, wherein the fifth wall includes a second recess and includes another hole, wherein the second proximal end includes third and fourth walls each including a hole, wherein the second connecting end is located intermediate the third and fourth walls, with the first and second walls including another hole, wherein the second handle is pivotally connected with the first handle by a second fastener inserted in the axial direction through the another hole of the first wall, the hole of the third wall, the hole of the fourth wall, the another hole of the second wall and the another hole of the fifth wall, wherein a second fixing element is received into the second recess and threaded onto threads of the second fastener.

2. The compound action snips as claimed in claim 1, wherein the third and fourth wall each includes a further hole and the second connecting end includes a hole, wherein the second connecting end is mounted to the second proximal end by a third fastener sequentially inserted in the axial direction through the further hole of the third wall, the hole of the second connecting end of the second blade and the further hole of the fourth wall, and wherein a third fixing element is threaded onto threads of the third fastener, with the second handle and the second blade connected with each other by the third fastener.

3. Compound action snips comprising:

a first handle including first distal and first proximal ends disposed opposite to each other, with the first proximal end including first and second walls arranged opposite to each other, with each of the first and second walls including a hole;

a second handle pivotally connected with the first handle and including second distal and second proximal ends disposed opposite to each other;

a first blade including a first connecting end and a first cutting end, with the first connecting end located intermediate the first and second walls of the first proximal end, with the first connecting end including a hole;

a second blade including a second connecting end and a second cutting end, with the second connecting end mounted to the second proximal end, wherein the first and second cutting ends enable cutting an object;

a nameplate including a fifth wall having an inner surface abutted against the second wall of the first handle and having an outer surface opposite to the inner surface, with the fifth wall including a first recess extending from the outer surface and including a hole;

a first fastener inserting in an axial direction through the holes of the first wall, the first connecting end, the second wall and the fifth wall; and a first fixing element received into the first recess and threaded onto threads of the first fastener to fasten the first handle, the first blade and the nameplate;

wherein a top surface is defined on the first fixing element in the axial direction and opposite the second wall; wherein the top surface of the first fixing element received in the first recess is not exposed out of the fifth wall of the nameplate, wherein the nameplate includes a sixth wall abutted against the first wall and including a hole, wherein the fifth wall includes a second recess and includes another hole, wherein the second proximal end includes third and fourth walls each including a hole, wherein the second connecting end is located, intermediate the third and fourth walls, with the first and second walls including another hole, wherein the second handle is pivotally connected with the first handle by a second fastener inserted in the axial direction through the hole of the sixth wall, the another hole of the first wall, the hole of the third wall, the hole of the fourth wall, the another hole of the second wall and the another hole of the fifth wall, wherein a second fixing element is received into the second recess and threaded onto threads of the second fastener.

4. The compound action snips as claimed in claim 3, wherein the nameplate is substantially U-shaped and includes a third connecting wall disposed between the fifth and sixth walls.

5. The compound action snips as claimed in claim 3, wherein the third and fourth wall each includes a further hole and the second connecting end includes a hole, wherein the second connecting end is mounted to the second proximal end by a third fastener sequentially inserted in the axial direction through the further hole of the third wall, the hole of the second connecting end of the second blade and the further hole of the fourth wall, and wherein a third fixing element is threaded onto threads of the third fastener, with the second handle and the second blade connected with each other by the third fastener.

* * * * *